US006687664B1

(12) United States Patent
Sussman et al.

(10) Patent No.: US 6,687,664 B1
(45) **Date of Patent: *Feb. 3, 2004**

(54) AUDIO-VISUAL SCRUBBING SYSTEM

(75) Inventors: Robert Sussman, Capitola, CA (US); Jean Laroche, Santa Cruz, CA (US); Mark Dolson, Ben Lomond, CA (US)

(73) Assignee: Creative Technology, Ltd., Creative Resource (SG)

( * ) Notice: Subject to any disclaimer, the term of this patent is extended or adjusted under 35 U.S.C. 154(b) by 0 days.

This patent is subject to a terminal disclaimer.

(21) Appl. No.: 09/419,128

(22) Filed: Oct. 15, 1999

(51) Int. Cl.[7] ..... G10L 19/00

(52) U.S. Cl. ..... 704/201; 704/501; 704/207; 704/200.1; 704/258; 707/500.1; 345/723

(58) Field of Search ..... 704/200.1, 500–504, 704/207, 258, 201–206; 345/723; 707/500.1, 500; 700/94; 381/54

(56) References Cited

U.S. PATENT DOCUMENTS 5,600,775 A * 2/1997 King et al. ..... 707/500
5,826,102 A * 10/1998 Escobar et al. ..... 707/500.1
6,262,724 B1 * 7/2001 Crow et al. ..... 345/723
6,526,325 B1 * 2/2003 Sussman et al. ..... 700/94

OTHER PUBLICATIONS

Laroche et al., ("Improved Phase Vocoder Time–Scale modification of Audio", IEEE transactions on Speech and Audio processing, May 1999, vol. 7, issue 3, pp. 323–332).*
Cox et al., ("Low Bit–Rate Speech Coders for Multimedia Communication", IEEE Communications Magazine, vol. 34, Issue 41, pp. 34–41, Dec. 1996).*
Laroche et al., ("New Phase–vocoder techniques for pitch–shifting, harmonizing and other exotic effects", 1999 Workshop on Applications of Signal Processing to Audio and Acoustics, pp. 91–94).*
Laroche et al., ("Phase–vocoder: about this phasiness business", 1997 IEEE ASSP Workshop on Applications of Signal Processing Audio and Acoustics, pp. 19–22).*
Sylvestre et al., ("Time–scale modification of speech using an incremental time–frequency approach with waveform structure compensation", ICASSP–92, 1992 IEEE International Conference on Acoustics, Speech, and Signal Processing, 1992, vol. 1, pp. 81–84).*
Quatieri et al., ("Shape invariant time–scale and pitch modification of speech", IEEE Transactions on Signal Processing, vol. 40 Issue 3, pp. 497–510).*

* cited by examiner

*Primary Examiner*—Vijay Chawan
(74) *Attorney, Agent, or Firm*—Blakely, Sokoloff, Taylor & Zafman LLP

(57) ABSTRACT

A method and apparatus for an audio scrubbing system for synchronizing audio to an asynchronous clock while preserving pitch utilizes a phase-vocoder to implement time-scaling without pitch-shifting.

10 Claims, 2 Drawing Sheets

AUDIO-VISUAL SCRUBBING SYSTEM

BACKGROUND OF THE INVENTION

Scrubbing systems are used in many digital audio workstations (DAW). These systems have their origin in analog tape playback systems where a location on an analog tape audio recording could be located by "scrubbing" the tape back and forth across the play head of the playback device thus causing playback in the speed and direction of movement of the tape. As known in the art, "digital audio scrubbers" are systems in which the user scans portions of an audio recording with an input device, which results in the audio playback of the scanned portion; the instantaneous playback position of the audio tracks the position of the user's input device. The system is typically used to locate splice points or audio artifacts in the program.

DAWs often have two methods of scrubbing. The first method allows the user to control the instantaneous playback position of the audio data. The second method allows the user to control the playback rate and direction of the audio data. In the first method a plot of an audio waveform is displayed and the user drags a mouse or other input device that directs a control icon on the display back and forth over a portion of the waveform to be played. As the control icon moves it directs the instantaneous playback position of the audio to be played. The rate of change of position of the control icon thus ultimately directs the audio playback speed and direction. If the user scrubs the mouse from left to right the audio will play back in the forward direction. Likewise, a mouse movement from right to left will result in reverse playback. If the user stops moving the mouse the audio is frozen in the current location. Scrubbing is activated either by holding down a key, or a mouse button, or it is toggled on and off by clicking a mouse button or with a key press.

In a second method a "jog-wheel" is used. The "jog-wheel" can be a physical input device connected to the scrubbing system or it can be a virtual input device, such as a slider, on the graphical display and controlled with a mouse. The "jog-wheel" is moved in one direction to start forward playback and the opposite direction to start reverse playback. When the "jog-wheel" is released it returns to center automatically and playback stops. The playback speed is controlled by the amount the "jog-wheel" is moved from its resting position. In both methods of scrubbing as playback occurs a visual indication of the playing audio is shown. Often a cursor in the form of a simple line is moved over the audio waveform.

Typical audio-visual scrubbing systems use sample rate conversion to adjust the speed of the audio playback. When scrubbing in the mode that controls speed and direction directly this is fairly straightforward. When scrubbing in the mode that controls instantaneous playback position the speed is constantly adjusted to try and track the playback position indicated from the user. Using sample rate conversion offers two disadvantages: 1) The playback pitch is shifted proportionately to the playback speed. At very slow and fast playback speeds the audio will sound quite differently from the original. Also, when the user stops moving the input device the audio will be muted. 2) Many systems have a large output latency, which result in a system that is difficult to control.

It is desired to have a system where 1) playback speed can be controlled independently of pitch, 2) synchronization between audio playback and the user's input device can be obtained, and 3) it is possible to for the user to hold the input device at one position in the audio waveform and have the audio at that position sustain playback.

SUMMARY OF THE INVENTION

According to one aspect of the invention, an audio scrubber GUI includes a representation of a media file, a control icon, and a user input device. An audio system utilizes a phase-vocoder to implement playback of a portion of the media file indicated by the control icon. A user input device is used to manipulate the control icon to indicate the instantaneous position, or equivalently the direction and speed of playback of the media file. The phase-vocoder allows the playback rate to be varied while preserving pitch and also allows for pitch modification independent from the playback rate.

According to another aspect of the invention, the audio system synchronizes the playback of the media file to the asynchronous clock output by the audio scrubber system. For this aspect the instantaneous position of the input device is periodically translated to a playback media time. This playback media time can be viewed as a clock signal to synchronize audio playback with.

According to another aspect of the invention, the media file is analyzed in real time to facilitate real time playback in response to manipulations of the control icon.

According to another aspect of the invention, a specified motion of the control icon can cause pitch shifting independent of playback rate or if playback is paused.

Additional advantages and features of the invention will be apparent in view of the following detailed description and appended drawings.

DESCRIPTION OF THE SPECIFIC EMBODIMENTS

Figure 1B:
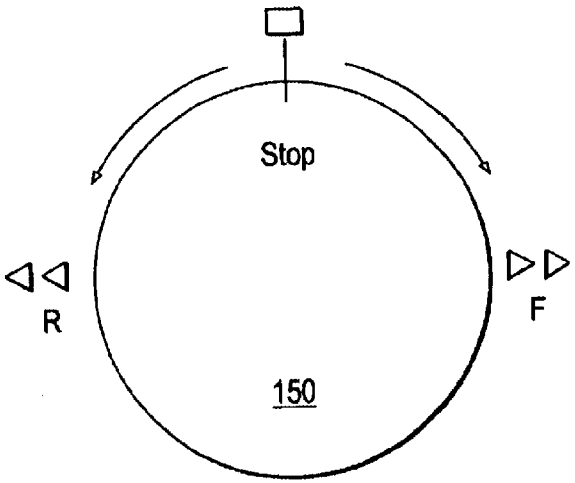
FIG. 1 is a schematic diagram of a preferred embodiment of the GUI of the present invention.
Figure 1A:
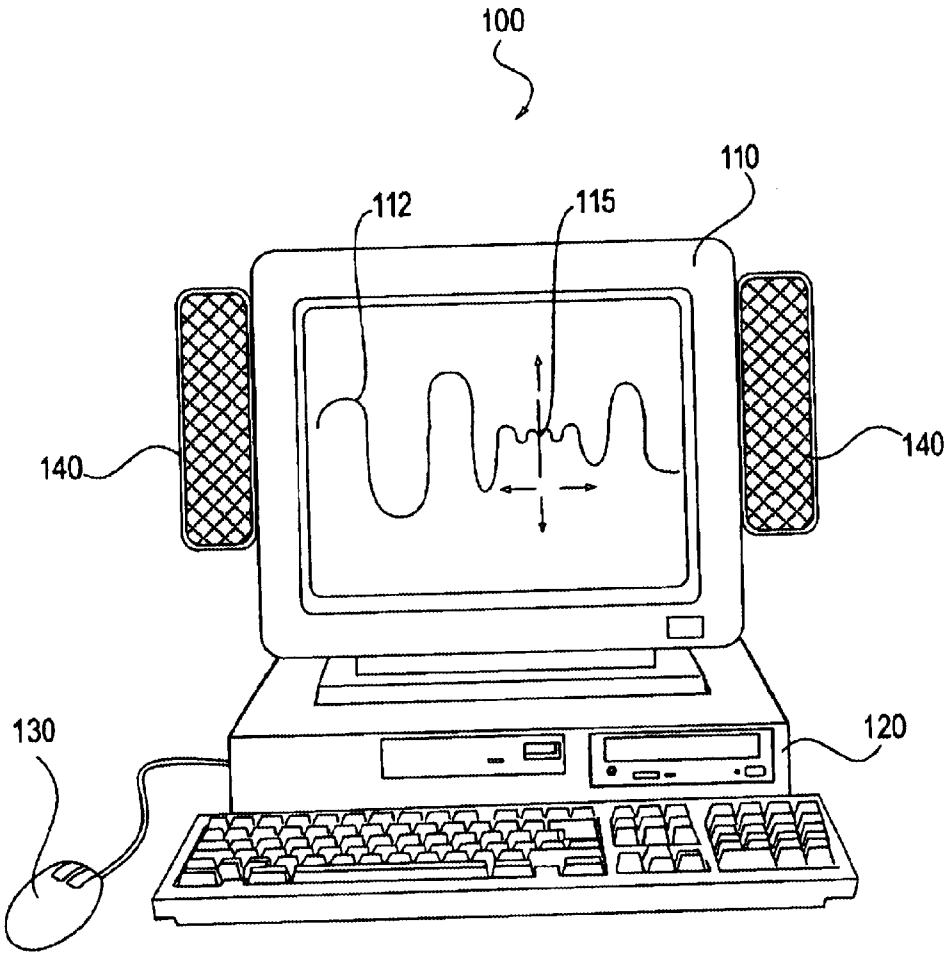

FIG. 1A depicts a first preferred embodiment of the present invention which is an improved graphical user interface (GUI) utilized with an audio-scrubber system that provides independent control of playback rate (time compression/expansion) and pitch shifting.

To aid in the control and processing of the audio program, scrubber 100 implements a graphical user interface (GUI). In one embodiment, scrubber 100 includes a monitor 110 for displaying an audio waveform 112, computer 120, an input device (mouse) 130, and audio output unit 140. Mouse 130 controls a control icon (cursor) 115 for scanning the audio waveform display 112.

In operation, the monitor 110 displays the cursor's position along waveform 112 and outputs audio effects corresponding to the cursor's displayed position. During a scrubbing operation, the user moves mouse 130 to move cursor 115 along the audio waveform 112, thereby generating audio effects corresponding to the scanned waveform portion(s). In a specific embodiment, the user may position the mouse over a particular waveform portion to sustain that portion's audio output or move the mouse perpendicularly to the waveform portion to vary the pitch. Mouse 130 may be moved in a combination of both directions to simultaneously select different waveform portions while varying the audio pitch.

As the user scans waveform 112 at varying speeds and/or in different directions, the rate at which the cursor changes position will vary thereby causing a change in output rate of a clock signal. Synchronization to the variable rate clock signal is critical to ensure accurate correlation between the cursor position and the output audio effects. Moreover, pitch preservation is preferred in scanning waveform 112 at varying speeds and directions.

In the preferred embodiment, time scaling and pitch modification are implemented by a phase-vocoder technique. The analysis time of the phase-vocoder is derived from a clock signal output from the audio scrubber, which indicates the media time and playback rate selected by the user of the audio scrubber. The phase-vocoder processes raw data from a media file in real time to provide playback of the media file at the playback rate and pitch selected by the user. The phase-vocoder allows the playback rate to be varied without changing pitch and also allows the pitch to be changed without changing the playback rate.

The phase vocoder is a well-known tool for high fidelity time scale modification of digital audio and is described in a paper by Dolson entitled "The Phase Vocoder: A Tutorial" *Computer Music J*, vol. 10, no. 4, pp. 14–27, 1986. In the phase vocoder a succession of Fourier transforms of an audio signal are taken over finite-duration windows, or frames, in time.

Time-scale modification with the phase-vocoder involves a Short-Term Fourier Transform (STFT) in which the hop size (the time-interval between successive frames) is not the same at the input and at the output. For example, to stretch a signal by 30%, the input hop size would be 30% smaller than the output hop size. The output hop size is usually kept constant, while the input hop size can vary to accommodate the desired local time-scaling factor. The phase of the synthesis inverse FFTs must be adjusted according to the change in hop size between the input and output of the phase vocoder. In a preferred embodiment, the FFTs and inverse FFTs are implemented in the DSP.

FIG. 1B depicts a second preferred embodiment of invention. In this case, the user input device is a jog-wheel 150. When the jog-wheel is rotated clockwise in the fast-forward direction (FF) the playback of the media file starts from a start position and the playback rate is controlled by the amount of clockwise rotation of the jog-wheel 150. The input hop size of the FFT is determined by position of the jog-wheel 150 to control the pitch-preserved playback rate. When the jog-wheel 150 is rotated counter-clockwise in the reverse direction (R) the media starts from the start position and the reverse playback rate is controlled by the counter-clockwise rotation of the jog-wheel 150. The negative input hop size (for reverse playback at a pitch-preserved variable rate) is determined by the position of the jog-wheel. When the jog-wheel is released the playback stops at a stop position. The stop position and start position are media times which are converted to analysis times by the phase-vocoder.

Figure 2:
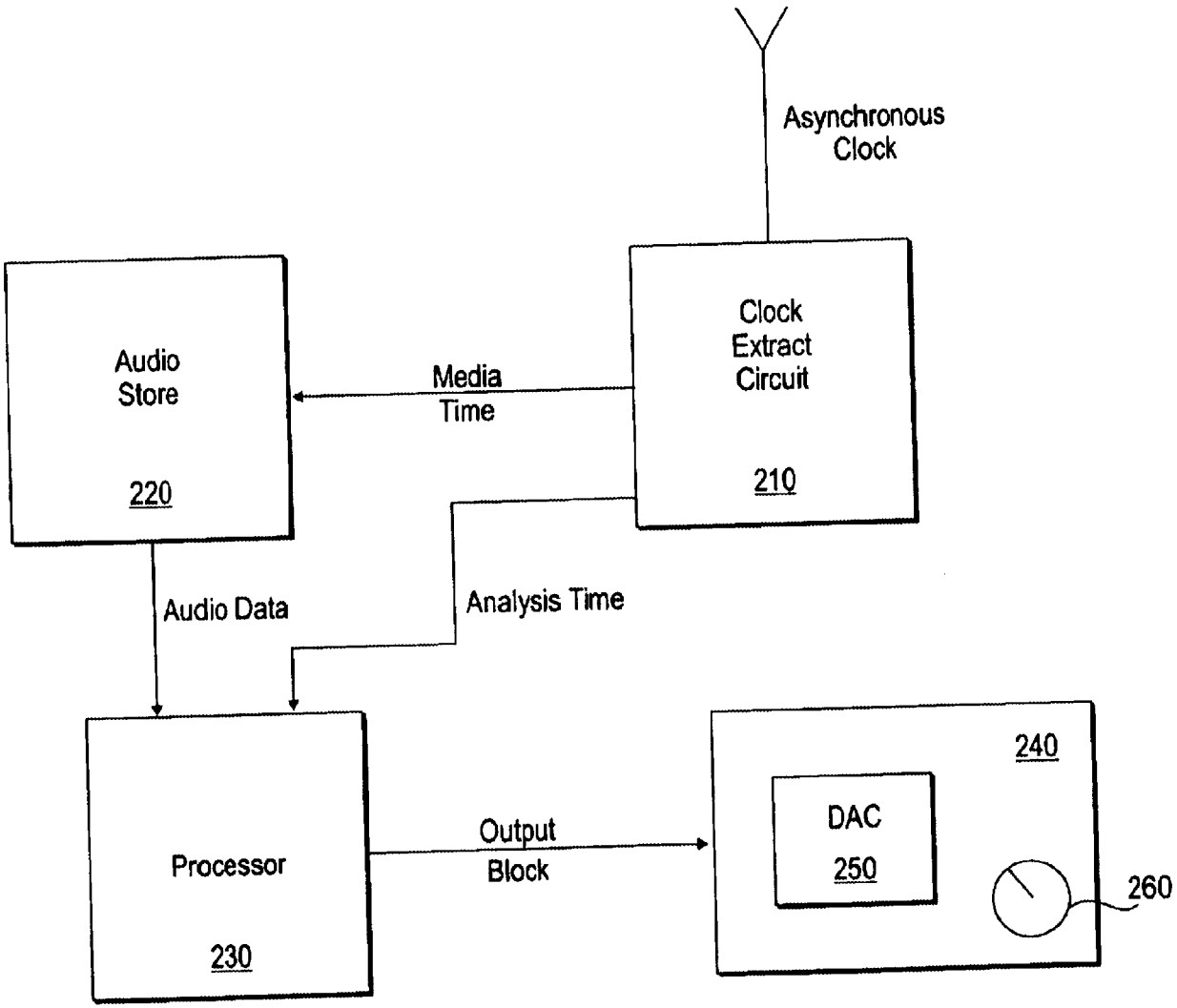
FIG. 2 is a block diagram of an audio system for implementing an embodiment of the present invention.

FIG. 2 is a block diagram of an audio processing system for responding to the position of the control icon. In FIG. 2 an audio system 200 includes a clock extraction circuit 210 which receives an asynchronous clock signal, a audio store 220 for storing an audio signal in digital format, a processor 230, and an audio output unit 240 that contains the Digital to Analog Converter (DAC) 250 and the DAC sample clock 260. In a preferred embodiment the processor 230 is a digital signal processor (DSP).

The user may "scrub" the file backward, forward, or freeze time, independently varying the playback rate and pitch as desired. A more detailed description of the implementation of clock synchronization and the operation of the phase-vocoder is set forth in the co-pending application (now U.S. Pat. No. 6,526.325), entitled "Pitch-Preserved Digital Audio Playback Synchronized to Asynchronous Clock", filed on the same date as the present application and hereby incorporated by reference for all purposes.

The invention has now been described with reference to the preferred embodiments. Alternatives and substitutions will now be apparent to persons of skill in the art. In particular, different display and input devices can be utilized to implement the invention. For example, an LCD display on a stand alone product such as a hard disk recording device could be used. In addition the input device could be a physical wheel that is or is not spring loaded to return to center upon release or a slider displayed on a computer monitor. Accordingly, it is not intended to limit the invention except as provided by the appended claims.

What is claimed is:

1. An audio scrubber system for processing a media file comprising:

a graphical user interface displaying a representation of the media file and a control icon for selecting a portion of the media file;

a user input device for allowing the user to manipulate the control icon to selectively indicate playback of the media file in a forward direction and in a reverse direction; and an audio processing system, responsive to manipulation of the control icon, for implementing a phase-vocoder to playback a portion of an audio stream contained in the media file in real-time, the audio processing system comprising:

a clock extraction circuit operable to receive a clock signal produced in response to manipulation of the control icon and to generate a current analysis time specifying the audio stream synchronized to the clock signal, the clock signal indicating playback of audio stream in the forward direction or in the reverse direction;

an audio store, coupled to the clock extraction circuit, for storing the audio stream in digital format and for providing a current block of the audio stream specified by the current analysis time;

a processor, coupled to the audio store to receive the current block, the processor operable to:

perform an FFT on the current block to generate a set of frequency bins;

perform an inverse FFT on the frequency bins to generate a current output block of an audio output stream;

set an input phase vocoder input hop size equal to the difference between the current analysis time and an immediately previous analysis time divided by a sampling rate;

adjust a phase of the current output block relative to a previous output block based on the input hop size; and overlap the current output block with a previous output block separated by a fixed output hop size; and an audio output unit that contains a Digital to Analog Converter (DAC) and a DAC sample clock for providing a constant DAC clock rate, the audio output unit being coupled to the processor to receive the current output block and to render the current output block at the DAC clock rate.

2. The system of claim 1 where:

said audio processing system is responsive to vertical motion of the control icon, for implementing phase-vocoder change of pitch of a portion of the media file selected by the control icon.

3. The system of claim 1 where:

said audio processing system is responsive to pausing the control icon for implementing phase-vocoder sustainment of playback of portion of the audio file selected by the control icon.

4. A method for scrubbing an audio file, said method comprising the steps of:

displaying a representation of the audio file and a control icon;

manipulating the control icon to produce a clock signal indicating forward or reverse playback of the media file at a desired playback rate;

accessing an audio input stream from a portion of the media file indicated by a current location of the control icon;

extracting a current analysis time from the clock signal;

accessing the audio input stream based on the current analysis time to obtain a current input block;

setting a phase vocoder input hop size equal to the difference between the current analysis time and an immediately previous analysis time;

performing an FFT on the current input block to generate a set of frequency bins;

performing an inverse FFT on said frequency bins to generate a current output block of an audio output stream; and overlapping the current output block with a previous output block separated by a fixed output hop size.

5. The method of claim 4 further comprising the step of:

manipulating the control icon to indicate a selected change of pitch of a portion of the media file; and utilizing a phase-vocoder to implement the selected pitch change independently of the playback rate of the audio file.

6. An audio scrubber system for processing a media file comprising:

a graphical user interface displaying a representation of the media file and a control icon for selecting a portion of the media file;

a user input device for allowing the user to control the playback rate of the media file starting at the portion of the media file selected by the control icon; and an audio processing system, responsive to displacement and direction of displacement of the user input device, for implementing a phase-vocoder to playback the portion of the media file in real-time in a direction and rate indicated by an amount of displacement and direction of displacement of the user input device while preserving pitch, wherein a clock signal is produced indicative of the displacement and the direction of displacement, the audio processing system configured to perform the steps of:

extracting a current analysis time from the clock signal;

accessing a current input block of an audio stream contained in the portion of the media file selected by the control icon, the current input block corresponding to the current analysis time;

setting a phase vocoder input hop size equal to the difference between the current analysis time and an immediately previous analysis time;

performing an FFT on the current input block to generate a set of frequency bins;

performing an inverse FFT on said frequency bins to generate a current output block of an audio output stream; and overlapping the current output block with a previous output block separated by a fixed output hop size.

7. The system of claim 6 wherein:

said user input device is a jog-wheel that indicates a playback rate proportional to an amount of rotation from a start position.

8. A method for producing an audio output stream that is synchronized to an asynchronous clock, said method comprising the steps of:

presenting a graphical representation of an audio input stream;

presenting a graphical representation of a control icon;

detecting an indication of manipulations of the control icon and producing a variable rate asynchronous clock in response thereto;

extracting a current analysis time from the variable rate asynchronous clock;

accessing a current input block from the audio input stream for the purpose of generating an audio output stream, the current input block corresponding to the current analysis time;

setting a phase vocoder input hop size equal to the difference between the current analysis time and an immediately previous analysis time;

performing an FFT on the current input block to generate a set of frequency bins;

performing an inverse FFT on the frequency bins to generate a current output block of the audio output stream; and overlapping the current output block with a previous output block separated by a fixed output hop size.

9. The system of claim 8 wherein the control icon is a cursor, the method further including detecting input from an input device, the manipulation of the control icon being based on the input from the input device.

10. The system of claim 8 wherein the control icon is representative of a jog-wheel.

* * * * *